US007450867B2

(12) United States Patent
Itoyama et al.

(10) Patent No.: US 7,450,867 B2
(45) Date of Patent: Nov. 11, 2008

(54) IMAGE FORMING APPARATUS, TONER DENSITY CONTROL METHOD, TONER DENSITY CONTROL PROGRAM AND STORAGE MEDIUM FOR STORING THE PROGRAM

(75) Inventors: Motoyuki Itoyama, Soraku-gun (JP); Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 356 days.

(21) Appl. No.: 11/299,262

(22) Filed: Dec. 7, 2005

(65) Prior Publication Data

US 2006/0127109 A1 Jun. 15, 2006

(30) Foreign Application Priority Data

Dec. 10, 2004 (JP) ..... 2004-359007

(51) Int. Cl.
*G03G 15/08* (2006.01)

(52) U.S. Cl. ..... 399/27; 399/30; 399/53; 399/58; 399/59; 399/60; 399/61; 399/62; 399/258

(58) Field of Classification Search ..... 399/27, 399/30, 53, 58–62, 258
See application file for complete search history.

(56) References Cited

U.S. PATENT DOCUMENTS 5,124,751 A 6/1992 Fukui et al.
5,708,917 A 1/1998 Kawai et al.
5,724,627 A * 3/1998 Okuno et al. ..... 399/27

FOREIGN PATENT DOCUMENTS

| | | | |
|---|---|---|---|
| JP | 61-215575 | | 9/1986 |
| JP | 04-019764 | | 1/1992 |
| JP | 04-304486 | | 10/1992 |
| JP | 05-027597 | A3 | 2/1993 |
| JP | 05-134550 | A | 5/1993 |
| JP | 08-248760 | A | 9/1996 |
| JP | 10-207214 | | 8/1998 |
| JP | 11-095538 | A | 4/1999 |
| JP | 2000-214672 | | 8/2000 |
| JP | 2002-196551 | | 7/2002 |
| JP | 2003-280384 | A | 10/2003 |
| JP | 2004-151375 | | 5/2004 |
| JP | 2004-198837 | | 7/2004 |

* cited by examiner

*Primary Examiner*—David M Gray
*Assistant Examiner*—Ryan D Walsh
(74) *Attorney, Agent, or Firm*—Edwards Angell Palmer & Dodge LLP; David C. Conlin; Lisa Swiszcz Hazzard

(57) ABSTRACT

An amount of toner consumption accompanying development of an image corresponding to the image data is calculated based on image data, and a corrected consumption amount is calculated by multiplying the calculated amount of toner consumption by a predetermined correction ratio that is less than 1. Further, toner is supplied based on the calculated corrected consumption amount. As a result, it is possible to prevent excessive supply of toner, and to supply toner without time delay.

13 Claims, 6 Drawing Sheets

IMAGE FORMING APPARATUS, TONER DENSITY CONTROL METHOD, TONER DENSITY CONTROL PROGRAM AND STORAGE MEDIUM FOR STORING THE PROGRAM

This non-provisional application claims priority under 35 U.S.C. § 119(a) on Patent Application No. 2004-359007 filed in Japan on Dec. 10, 2004, the entire contents of which are hereby incorporated by reference.

FIELD OF THE INVENTION

The present invention relates to an image forming apparatus using two-component developer, a toner density control method, a toner density control program, and a storage medium for storing the program.

BACKGROUND OF THE INVENTION

Conventionally, each of electrophotographic image forming apparatuses (printing apparatuses) such as copying machines, printers and facsimiles is provided with a photoconductor drum, a charge device, an exposure device, a developing device, a transfer device, a fixing device, and the like.

In the image forming apparatus, the exposure device performs exposure with respect to a photosurface (electrostatic latent image face) of the photoconductor drum charged by the charge device so as to form an electrostatic latent image. In the developing device, the formed electrostatic latent image is developed with toner (developer) so as to form a toner image (visible image). The toner image is transferred to a sheet (recording material; printing medium such as a standard paper or an OHP sheet), and then fixed by the fixing device.

In the image forming apparatus, density of toner used for development has an influence on quality of a formed image. Therefore, in conventional image forming apparatus, in order to always acquire images having constant density, the density of the toner is detected, and when the density of the toner drops, toner is supplied, thereby controlling the density of the toner in a suitable range.

For example, each of Japanese Laid-Open Patent Publication No. 215575/1986 (Tokukaishou 61-215575) (published on Sep. 25, 1986) and Japanese Laid-Open Patent Publication No. 207214/1998 (Tokukaihei 10-207214) (published on Aug. 7, 1998) discloses a technique in which an amount of toner supply is controlled according to a result of detection carried out by a toner density sensor.

Further, Japanese Laid-Open Patent Publication 304486/1992 (Tokukaihei 4-304486) (published on Oct. 27, 1992) discloses a technique in which a toner consumption ratio is calculated based on (i) a printing ratio obtained from pixel data to be printed and (ii) page number information, and toner is supplied based on the thus calculated toner consumption ratio. Further, Japanese Laid-Open Patent Publication 304486/1992 discloses a technique in which a cumulative error of the calculated toner consumption ratio is corrected through judgment on a threshold value of an output from a toner density detection device.

Further, Japanese Laid-Open Patent Publication No. 214672/2000 (Tokukai 2000-214672) (published on Aug. 4, 2000) discloses a technique in which: in a case where the printing ratio obtained from the pixel data is large, toner supply is controlled so that the output from the toner density sensor is a standard value, and in a case where the printing ratio obtained from the pixel data is small and the output from the toner density sensor is small, when the density of a patch image detected by an optical sensor is not less than a standard value, toner is intermittently supplied, and when the density of the patch image is not more than the standard value, toner is continually supplied.

Further, Japanese Laid-Open Patent Publication No. 151375/2004 (Tokukai 2004-151375) (published on May 27, 2004) discloses a technique in which the threshold value of the output from the toner density sensor is corrected based on the printing ratio obtained from the pixel data so as to control the toner supply.

However, as in the techniques disclosed in Japanese Laid-Open Patent Publication No. 215575/1986, Japanese Laid-Open Patent Publication No. 207214/1998, and Japanese Laid-Open Patent Publication No. 151375/2004, when toner supply is controlled based on the result of detection carried out by the toner density sensor, it takes time to actually supply toner after detecting the toner density, and accordingly supply operation is delayed. Therefore, toner density tends to be insufficient.

Further, as in the techniques disclosed in Japanese Laid-Open Patent Publication 304486/1992 and Japanese Laid-Open Patent Publication No. 214672/2000, when the amount of toner supply is controlled based on the printing ratio obtained from the pixel data to be printed, there is a case where, for example, an amount of supplied toner is different from an amount that is actually needed because of a difference between the amount of toner consumption based on the calculated printing ratio and an amount of actual toner consumption. Particularly, when toner is excessively supplied, the only way to reduce an amount of the excessively supplied toner is to consume toner by printing so that toner density is optimized. Therefore, quality of an image developed on a recording material inevitably drops.

SUMMARY OF THE INVENTION

The present invention was made in view of the foregoing problems, and its object is to provide an image forming apparatus, a toner density control method, and a toner density control program, each of which can prevent excessive supply of toner and perform toner supply without time delay.

In order to solve the problems, an image forming apparatus according to the present invention is an image forming apparatus for developing, on a recording medium, an image corresponding to image data, by use of two-component developer constituted of toner and carrier, the image forming apparatus comprising: a developing chamber for containing the two-component developer used for development of the image; a supply member for supplying toner to the developing chamber; a toner consumption amount calculation section for calculating, based on the image data, an amount of toner consumption accompanying development of the image corresponding to the image data; a corrected consumption amount calculation section for calculating a corrected consumption amount by multiplying the calculated amount of toner consumption by a predetermined correction ratio that is less than 1; and a toner density control section for causing the supply member to perform main supply in which toner is supplied to the developing chamber based on the calculated corrected consumption amount and for controlling toner density of the two-component developer contained in the developing chamber.

Further, in order to solve the problems, a toner density control method according to the present invention is a toner density control method for controlling toner density of two-component developer, constituted of toner and carrier, which is contained in a developing chamber included in an image forming apparatus for developing, on a recording medium, an image corresponding to image data, by use of the two-component developer, the toner density control method comprising: a toner consumption amount calculation step for calculating, based on the image data, an amount of toner consumption accompanying development of the image corresponding to the image data; a corrected consumption amount calculation step for calculating a corrected consumption amount by multiplying the calculated amount of toner consumption by a predetermined correction ratio that is less than 1; and a main supply step for supplying toner to the developing chamber based on the calculated corrected consumption amount.

With the image forming apparatus and the toner density control method, an amount of toner consumption accompanying development of an image corresponding to the image data is calculated based on image data, and toner is supplied to the developing chamber based on a corrected consumption amount calculated by multiplying the calculated amount of toner consumption by a predetermined correction ratio that is less than 1. In this way, by controlling toner supply based on the amount of toner consumption calculated from image data, it is possible to supply toner with little time delay from actual toner consumption. Further, by controlling an amount of toner supply based on the corrected consumption amount calculated by multiplying the calculated amount of toner consumption by a predetermined correction ratio that is less than 1, it is possible to prevent excessive supply of toner and suitably control an amount of toner supply even when there is a difference between the amount of toner consumption calculated from image data and the amount of actual toner consumption.

The toner density control program according to the present invention causes a computer to carry out the toner density control method. By causing a computer to read the program, it is possible for the computer to realize processing of each step in the toner density control method according to the present invention.

Further, by storing the program in a computer-readable storage medium, it is possible to easily maintain and distribute the program. Further, by causing a computer to read the storage medium, it is possible for the computer to carry out the processing of each step in the toner density control method according to the present invention.

For a fuller understanding of the nature and advantages of the invention, reference should be made to the ensuing detailed description taken in conjunction with the accompanying drawings.

DESCRIPTION OF THE EMBODIMENTS

Figure 2:
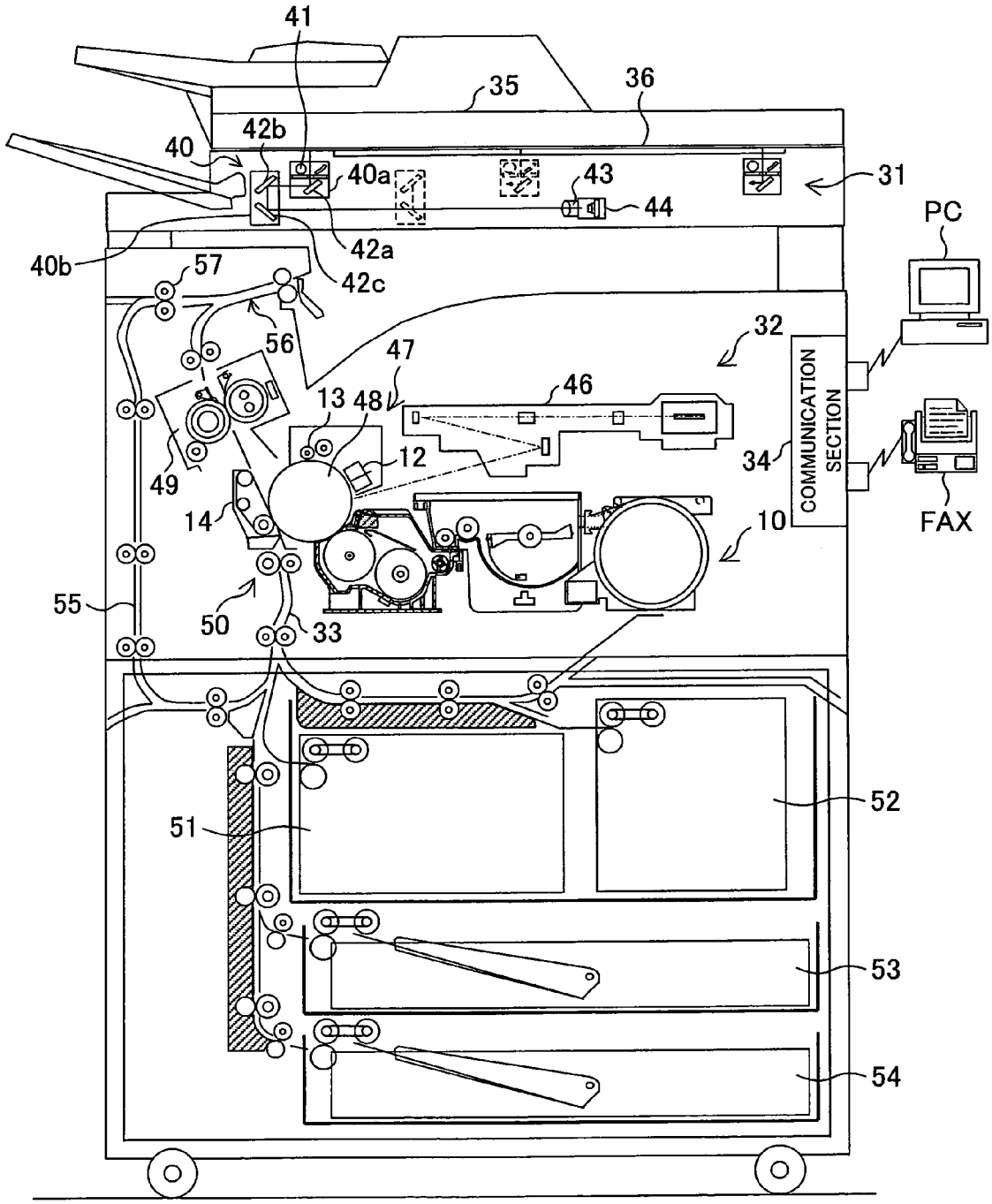
FIG. 2 is a cross sectional view illustrating a structure of the image forming apparatus according to one embodiment of the present invention.

One embodiment of the present invention is explained below with reference to figures. FIG. 2 is a cross sectional view schematically illustrating a structure of a copying machine 30 corresponding to an image forming apparatus according to the present embodiment. The copying machine 30 includes a developing device 10 that uses developer (two-component developer) made by combining toner and carrier (magnetic carrier).

[Structure of Copying Machine 30]

The copying machine 30 functions as a copying machine, a printer, and a facsimile device, and includes a scanner section 31, a communication section 34, and a laser printer section 32.

The scanner section 31 includes: a document placement table 35 made of transparent glass; a double-sided automatic document feeder (RADF; (Recirculating Automatic Document Feeder) 36 for automatically feeding and conveying a document to the document placement table 35; and a scanner unit 40 (document image reading unit for scanning and reading an image of a document placed on the document placement table 35). A document image read by the scanner section 31 is transmitted, as image data, to a later-mentioned image data input section, and predetermined image processing is performed based on the image data.

The RADF 36 sets a plurality of documents on a predetermined document tray (not shown) at a time, and automatically feeds each of the documents onto the document placement table 35. The RADF 36 has a function for conveying the documents to a predetermined taking-out position, after the scanner unit 40 has read a document image.

Further, the RADF 36 functions as a double-sided automatic document feeder. Namely, the RADF 36 includes not only a one-sided convey route for reading one side of a document, but also (i) a two-sided convey route for reading both sides of a document, (ii) a guide for switching convey routes, and (iii) sensors, a control section and the like for grasping (confirming) and managing a state of a document in each convey route (all of them are not shown). As a result, it is possible to reverse a document after reading a document image by the scanner unit 40, and then to convey the document to the document placement table 35 again.

The RADF 36 is set to read one side of a document or both sides of the document, according to a selection instruction inputted by a user (operator).

The scanner unit 40 is a document image reading unit for reading each line of an image of a document conveyed onto the document placement table 35. As illustrated in FIG. 2, the scanner unit 40 includes a first scanning unit 40*a*, a second scanning unit 40*b*, an optical lens 43, and a CCD 44.

The first scanning unit 40*a* exposes a document while moving along the document placement table 35 from left to right at a certain velocity V. As illustrated in FIG. 2, the first scanning unit 40*a* includes a lamp reflector assembly 41 for emitting light and a first reflection mirror 42*a* for leading reflected light from the document to the second scanning unit 40*b*.

The second scanning unit 40*b* moves at a velocity of V/2 along with the first scanning unit 40*a*. The second scanning unit 40*b* includes a second reflecting mirror 42*b* and a third reflecting mirror 42*c* for leading light reflected by the first reflecting mirror 42*a* toward the optical lens 43 and the CCD 44.

The optical lens 43 causes light reflected by the third reflecting mirror 42*c* to become an image on the CCD 44.

The CCD (photoelectric conversion device) 44 converts light, from which the image has been formed by the optical lens 43, into an electric signal (electric image signal). An analog electric signal obtained by the CCD 44 is converted by a CCD board (not shown) having the CCD 44 into image data constituted of a digital signal. The image data is subject to a variety of image processings in an image processing section, and then stored in a memory (not shown). Then, the image data is transmitted to the laser printer section 32 according to an output instruction of a main CPU (not shown) of the copying machine 30.

In this way, the scanner section 31 is arranged so that: while sequentially placing documents to be read on the document placement table 35, the RADF 36 and the scanner unit 40 operate in association with each other so that the scanner unit 40 moves along an under surface of the document placement table 35 so as to read each document image.

The communication section 34 communicates with an external apparatus such as a personal computer (PC) or a facsimile apparatus (FAX) via a wireless communication or a wired communication. As a result, it is possible to transmit image data read by the scanner section 31 to the external apparatus, or to form an image based on data received from the external apparatus, on a sheet (recording material or recording medium), by use of the laser printer section 32.

The laser printer section 32 forms an image on a sheet, based on image data. As illustrated in FIG. 2, the laser printer section 32 includes a laser writing unit 46, an electronic photography process section 47, and a sheet transport mechanism 50.

The laser writing unit 46 emits laser light to a photoconductor drum (latent image holder) 48 of the electronic photography process section 47 and forms an electrostatic latent image, based on image data read by the scanner section 31 (scanner unit 40) or image data received from the external apparatus. The laser writing unit 46 includes a semiconductor laser light source, a polygon mirror for deflecting laser light at a constant angular velocity, and an f-θ lens (all of them are not shown). Here, the f-θ lens corrects the laser light deflected by the polygon mirror so that the laser light is deflected on the surface of the photoconductor drum 48 at a constant angular velocity.

The electronic photography process section 47 includes the photoconductor drum 48, and includes a charger 12, a developing device 10, a transfer device 14, a detachment device (not shown), a cleaning device 13, and a charge eliminator (not shown), all of which are provided around the photoconductor drum 48.

The charger 12 evenly charges the surface of the photoconductor drum 48, so that the laser writing unit 46 forms an electrostatic latent image on the photoconductor drum 48.

The developing device 10 develops the electrostatic latent image formed on the photoconductor drum 48 by the laser writing unit 46 so as to form a toner image. The developing device 10 is detailed later.

The transfer device 14 electrostatically transfers, on a sheet (recording medium), the toner image formed by the developing device 10.

As illustrated in FIG. 2, the sheet transport mechanism 50 includes a transport section 33, cassette sheet feeders 51 through 54, a fixing device 49, a sheet reverse section 55, a re-feeding route 56, and a sheet delivery roller 57. The sheet transport mechanism 50 feeds a sheet to the electronic photography process section 47, fixes an image transferred on the sheet, and delivers the sheet to outside.

The transport section 33 transports a sheet to a predetermined transfer position (position where the transfer device is disposed) of the electronic photography process section 47.

Each of the cassette sheet feeders 51 through 54 accumulates sheets for transfer, and sends each sheet to the transport section 33 at a time of transfer.

The fixing device 49 fixes a toner image transferred on the sheet.

The sheet reverse section 55 reverses and delivers (switches back) the sheet having been subjected to transfer.

The re-feeding route 56 is a route for re-feeding the sheet to the transport section 33 so as to form an image on the back surface of the sheet after a toner image is fixed.

The sheet delivery roller 57 delivers the transferred sheet to a post-processing device (not shown).

[Structure of Developing Device 10]

Figure 3:
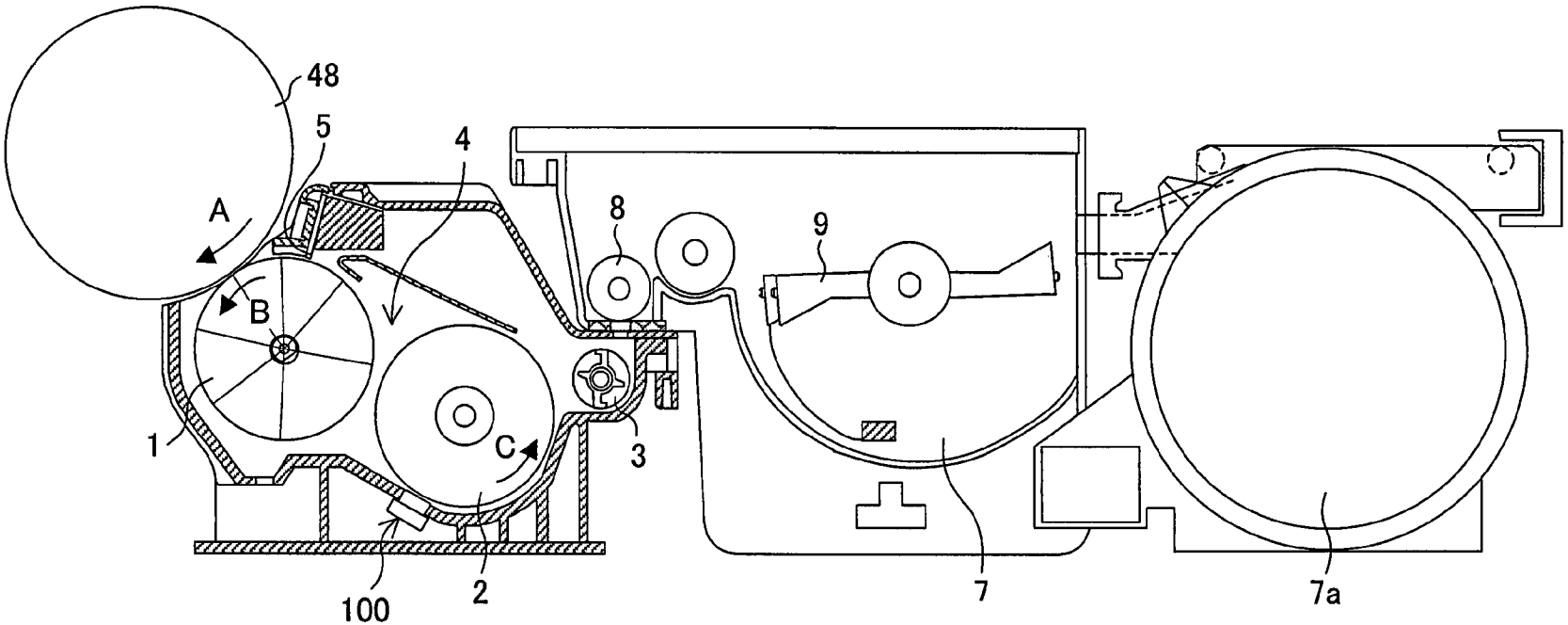
FIG. 3 is a cross sectional view schematically illustrating a structure of a developing device included in the image forming apparatus according to one embodiment of the present invention.

Next, the structure of the developing device 10 is explained. FIG. 3 is a cross sectional view illustrating the structure of the developing device 10. As illustrated in FIG. 3, the developing device 10 includes a developing roller (developer carrying portion) 1, stirring rollers 2 and 3, a developing chamber 4, a doctor blade 5, a toner supply tank 7, and a toner cartridge 7*a*.

The developing chamber 4 is a tank (toner tank) for containing toner (developer), and includes the developing roller 1, the stirring rollers 2 and 3, and the doctor blade 5. Further, a toner density sensor (magnetic permeability sensor) 100 is disposed on a bottom face of the developing chamber 4 so as to be positioned opposite to the stirring roller 2. Further, the developing chamber 4 is provided with an opening 6, and developer is supplied from the toner supply tank 7 via the opening 6.

The developing roller 1 is a cylindrical rotating roller partially exposed at an opening of the developing chamber 4, and the exposed part of the developing roller 1 is opposed to the photoconductor drum 48. The developing roller 1 carries toner contained in the developing chamber 4, and conveys the toner to the exposed part opposed to the photoconductor drum 48. As a result, it is possible to attach the toner to an electrostatic latent image formed on the photoconductor drum 48, and to form a toner image by developing the electrostatic latent image. Note that arrows A and B illustrated in FIG. 3 indicate rotative directions of the photoconductor drum 48 and the developing roller 1, respectively.

The doctor blade 5 is disposed at an upstream side with respect to a nip, between the developing roller 1 and the photoconductor drum 48 of the developing chamber 4, in the rotative direction of the developing roller 1. The doctor blade 5 defines a doctor gap Dg that is a gap between the developing roller 1 and an end of the doctor blade 5, and causes toner attached to the developing roller 1 to be partially even.

Figure 4:
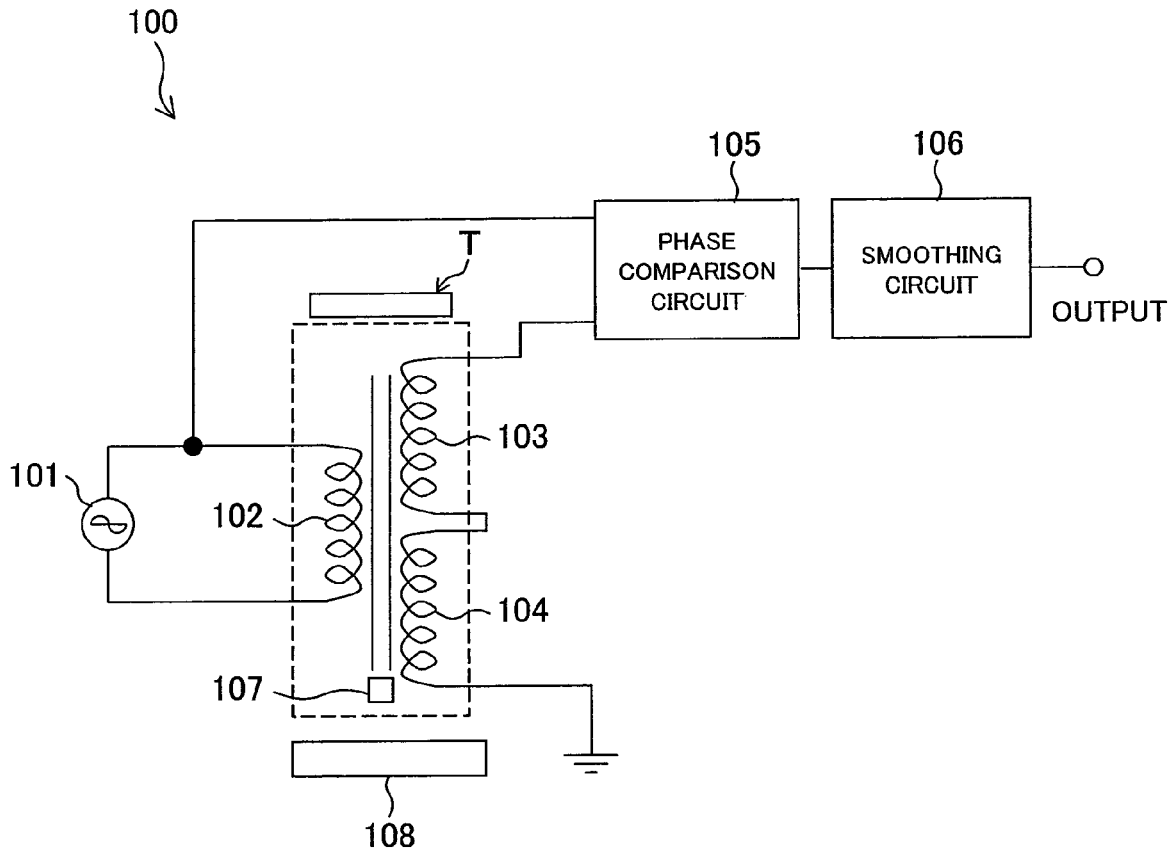
FIG. 4 is a block diagram schematically illustrating a structure of a toner density sensor included in the image forming apparatus according to one embodiment of the present invention.

The toner density sensor 100 is disposed on the bottom face of the developing chamber 4 so as to be positioned opposite to the stirring roller 2, and detects toner density. FIG. 4 is a block diagram schematically illustrating a structure of the toner density sensor 100. As illustrated in FIG. 4, the toner density sensor 100 includes a primary coil 102, a detection coil 103, a standard coil 104, a phase comparison circuit 105, and a smoothing circuit 106.

Both ends of the primary coil 102 are connected with an alternating current power source 101. Further, one end of the primary coil 102 is connected with the phase comparison circuit 105.

Two coils with substantially the same number of winding as each other and with polarity opposite to each other are cascaded at a secondary side of the primary coil 102. One of the two coils is the standard coil 104, and the other is the detection coil 103.

A screw core 107 having a high magnetic permeability is provided in a vicinity of the primary coil 102 and the standard coil 104, so as to function as a core. By adjusting a position of the screw core 107, it is possible to adjust inductance between the primary coil 102 and the standard coil 104.

Toner (developer) to be measured flows in vicinities of the primary coil 102 and the detection coil 103 (a region T in FIG. 4 and a region between the toner density sensor 100 and the stirring roller 2 in FIG. 3). The developer functions as a core so as to change the inductance between the primary coil 102 and the detection coil 103. The inductance is determined based on an amount of magnetic particles in the developer or magnetic carrier that functions as a core. Therefore, the amount of the magnetic particles, namely, toner density, can be measured based on the output voltage of the detection coil 103.

The standard coil 104 and the detection coil 103 have substantially the same number of winding as each other and have polarity opposite to each other. Further, the standard coil 104 and the detection coil 103 are cascaded with each other, and therefore a difference between the two coils can be acquired as an output of the two coils. The phase comparison circuit 105 calculates an exclusive logic sum between an alternating current voltage supplied to the primary coil 102 and the output from the standard coil 104 and the detection coil 103 that are coils at the secondary side. After that, an output signal of the phase comparison circuit 105 is smoothed by the smoothing circuit 106 and acquired as a direct current voltage. Note that the developing device 10 uses the output voltage so as to control the amount of toner (developer) supply. This will be detailed later.

The stirring rollers 2 and 3 stir the developer in the developing chamber 4 so as to minutely charge the developer. Note that an arrow C illustrated in FIG. 3 indicates a rotative direction of the stirring roller 2.

As illustrated in FIG. 3, the toner supply tank 7 is provided with an opening. Toner in the toner supply tank 7 is supplied to the developing chamber 4 via the opening of the toner supply tank 7 and the opening 6 of the developing chamber 4. To be more specific, a supply roller (supply member) 8 is provided in a vicinity of the opening of the toner supply tank 7, and a later-mentioned toner density control system 60 controls rotation of a supply roller driving motor for rotating the supply roller 8 so as to control the amount of toner to be supplied to the developing chamber 4. Note that the toner supply tank 7 is further provided with an opening different from the above opening. Via this opening, toner is supplied, according to necessity, from a toner cartridge 7*a* detachable from the toner supply tank 7. Further, a stirring member 9 for stirring toner (developer) is provided in the toner supply tank 7.

[Structure of Toner Density Control System 60]

Figure 5:
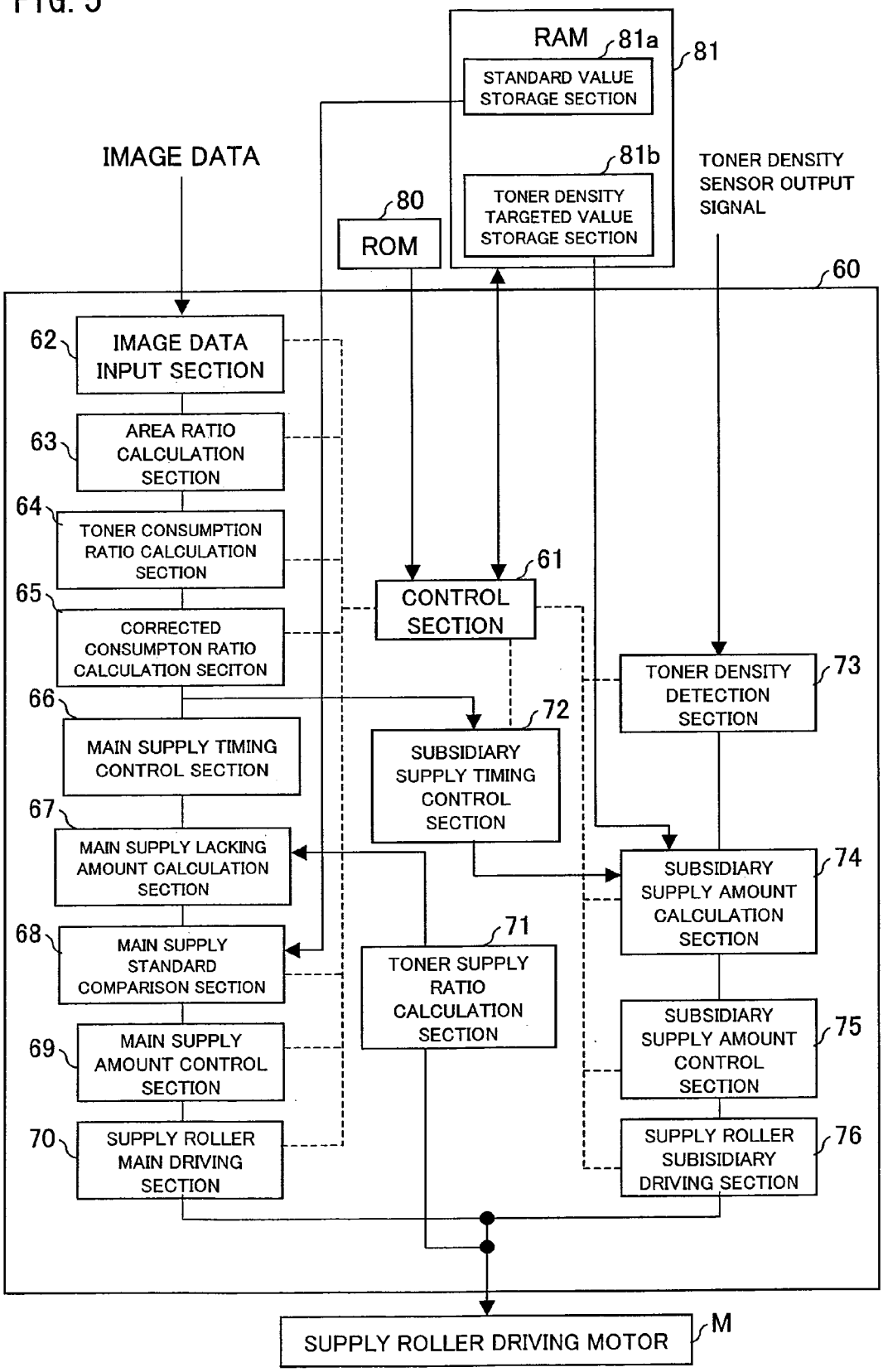
FIG. 5 is a block diagram illustrating a structure of a toner density control system included in the image forming apparatus according to one embodiment of the present invention.

FIG. 5 is a block diagram illustrating a structure of the toner density control system 60 in the copying machine 30. As illustrated in FIG. 5, the toner density control system 60 is provided with a control section 61, an image data input section 62, an area ratio calculation section 63, a toner consumption ratio calculation section 64, a corrected consumption ratio calculation section 65, a main supply timing control section 66, a main supply lacking amount calculation section 67, a main supply standard comparison section 68, a main supply amount control section 69, a supply roller main driving section 70, a toner supply ratio calculation section 71, a subsidiary supply timing control section 72, a toner density detection section 73, a subsidiary supply amount calculation section 74, a subsidiary supply amount control section 75, and a supply roller subsidiary driving section 76. Further, the toner density control system 60 is connected with a ROM 80, a RAM 81, and a supply roller driving motor M.

The control section (CPU) 61 is a pivotal portion of the toner density control system 60, and controls all operations of the toner density control system 60. Further, the ROM 80 stores a program for toner density control and the like, and the control section 61 reads and executes the program stored in the ROM 80 so as to control the operation of each section of the toner density control system 60. Note that the control section 61 may be a part of a main CPU of the copying machine 30.

The RAM 81 includes a standard value storage section 81*a* and a toner density targeted value storage section 81*b*. The standard value storage section 81*a* stores a standard value by which it is determined whether or not to supply toner based on a toner consumption ratio calculated from image data. The toner density targeted value storage section 81*b* stores a targeted value of toner density.

Note that the standard value stored in the standard value storage section 81*a* and the targeted value of toner density stored in the toner density targeted value storage section 81*b* may be stored beforehand in, for example, the ROM 80, or may be set by the user via input means (not shown).

Further, the control section 61 may temporarily store, in the RAM 81, information such as a program read from the ROM 80, or information of toner density based on the output voltage of the toner density sensor 100.

An image read by the scanner section 31 or image data received from an external apparatus via the communication section 34 is subjected to a predetermined image processing, and then inputted to the image data input section 62. Examples of the predetermined image processing include: a pre-processing carried out before subsequent image processings; input gamma correction in image adjustment; conversion; region separation processing; a region judgment processing for judging a character region, a halftone dot picture region, and the like; a region separation processing for adding a discrimination signal indicating a result of region judgment for each region; a color correction processing for converting image signals of RGB into image signals of CMYK (Cyan, Magenta, Yellow, Black); a scaling processing; a space filter processing; and a processing for correcting halftone gamma characteristics. The image data input section 62 outputs inputted image data to the area ratio calculation section 63.

The area ratio calculation section 63 multiplies image data (image signal or many-valued image) inputted from the image data input section 62 by a weight coefficient for each pixel, and performs pixel count of the image data, and calculates an area ratio that is a ratio of accumulation values of the pixel count to the area of an image forming region.

Here, a processing for calculating an area ratio is further detailed. Note that the processing described below is performed with respect to each color (for example, with respect to each of inputted CMYK signals), when a color image is formed.

Figure 6:
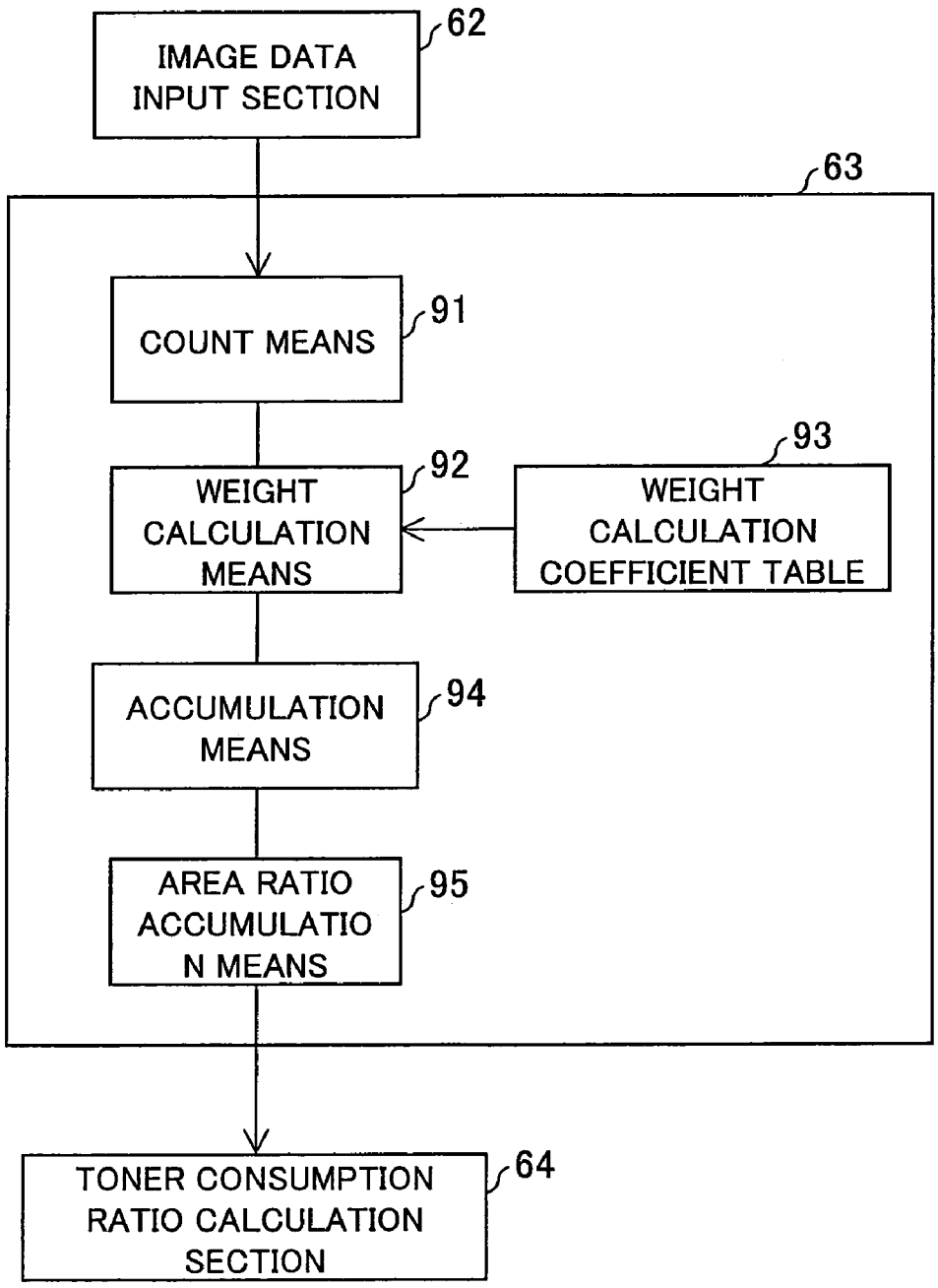
FIG. 6 is a block diagram illustrating a structure of an area ratio calculation section in the toner density control system included in the image forming apparatus according to one embodiment of the present invention.

FIG. 6 is a block diagram illustrating the structure of the area ratio calculation section 63. As illustrated in FIG. 6, the area ratio calculation section 63 is provided with count means 91, weight calculation means 92, a weight coefficient table 93, accumulation means 94, and area ratio calculation means 95.

The count means 91 counts an inputted many-valued image (for example, an image having multi-gradations such as 16 gradations or 256 gradations) for each pixel. Namely, the count means 91 counts an input signal value (gradation) for each pixel constituting a many-valued image. For example, in a case of 16 gradations whose input signal value ranges from 0 through 15, the count means 91 counts 0 through 15.

The weight calculation means 92 weights each pixel, when pixels are counted by the count means 91. To be specific, the weight calculation means 92 acquires, from the weight coefficient table 93, a weight coefficient corresponding to an input signal value for each pixel, and multiplies an input signal value by the acquired weight coefficient. The weight coefficient table 93 stores a weight coefficient corresponding to each input signal value at a time when the weight calculation means 92 weights an input signal value. In this way, a pixel count section 90 performs pixel count for each pixel, by use of the count means 91, the weight calculation means 92, and the weight coefficient table 93. Note that weight coefficients for each input signal value stored in the weight coefficient table 93 do not necessarily have a constant value. For example, the weight coefficients may be rewritable according to difference among copying machines 30 and to a change in toner consumption characteristics with passage of time, so that a difference between the calculated amount of toner consumption and the amount of actual toner consumption is small.

Next, accumulation of pixel count for each pixel is performed by the accumulation means 94. Namely, the accumulation means 94 accumulates calculation values of all the pixels of the inputted many-valued image, each of the calculation values being obtained by multiplying the input signal value by the weight coefficient of the weight calculation means 92.

After that, the area ratio calculation means 95 calculates a ratio (area ratio) of (i) sum of accumulation result (accumulation value of pixel count) given by the accumulation means 94 to (ii) the area of an image display region.

The toner consumption ratio calculation section 64 calculates a toner consumption ratio, namely, a toner consumption amount per unit time, based on the area ratio calculated by the area ratio calculation section 63.

The corrected consumption ratio calculation section 65 corrects the toner consumption ratio calculated by the toner consumption ratio calculation section 64 to be smaller than the result of calculation. At that time, correction is performed so that the corrected toner consumption ratio is always smaller than the actual toner consumption ratio, in consideration of a difference between the toner consumption ratio calculated by the toner consumption ratio calculation section 64 and the actual toner consumption ratio. Namely, correction is performed so that the corrected toner consumption ratio is smaller than a value calculated by subtracting the maximum value of a difference between (i) the toner consumption ratio calculated by the toner consumption ratio calculation section 64 and (ii) the real toner consumption ratio, from the toner consumption ratio calculated by the toner consumption ratio section 64. As a result, excessive supply of toner can be surely prevented.

The main supply timing control section (delay circuit) 66 delays the corrected toner consumption ratio (corrected consumption ratio) inputted from the corrected consumption ratio calculation section 65 by a predetermined time (delay time t1), and outputs the corrected toner consumption ratio to the main supply lacking amount calculation section 67. Note that, the delay time t1 is set as a time after the corrected consumption ratio calculation section 65 calculates a corrected consumption ratio based on image data so as to correspond to a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and is conveyed by the stirring rollers 2 and 3 to the vicinity of the supply roller 8.

The main supply lacking amount calculation section (subtraction processing section, integration processing section) 67 subtracts a supply amount per unit time (toner supply ratio) of toner that has been supplied during the delay time t1, from the corrected consumption ratio inputted from the main supply timing control section 66, and integrates the result of the subtraction, so as to calculate toner lacking amount. Note that the toner supply ratio is calculated by the toner supply ratio calculation section 71 based on a driving signal to the supply roller driving motor M, and outputted (fedback) to the main supply lacking amount calculation section 67.

The main supply standard comparison section 68 subtracts a standard value stored in the RAM 81 from the toner lacking amount calculated by the main supply lacking amount calculation section 67, so as to calculate a toner supply amount (main supply amount), and outputs the calculated main supply amount to the main supply amount control section 69.

When a signal indicative of the main supply amount inputted from the main supply standard comparison section 68 is not less than a predetermined value, the main supply amount control section 69 supplies, to the supply roller main driving section 70, a driving signal for driving the supply roller driving motor M. When the signal indicative of the main supply amount inputted from the main supply standard comparison section 68 is less than the predetermined value, the main supply amount control section 69 supplies, to the supply roller main driving section 70, a stop signal for stopping the supply roller driving motor M. Namely, when the toner amount calculated by the main supply lacking amount calculation section 67 is larger than the standard value stored in the standard valued storage section 81*a* in the RAM 81, the supply roller driving motor M is driven, and when the toner amount calculated by the main supply lacking amount calculation section 67 is smaller than the standard value stored in the RAM 81, the supply roller driving motor M is stopped.

The main supply amount control section 69 is constituted of, for example, a mono-stable multi-vibrator that outputs a pulse having a certain time interval when a trigger pulse is inputted, and is intermittently driven with a timing according to an amount of toner to be supplied. Note that the main supply control section 69 is not limited to the mono-stable multi-vibrator, and may be arranged so as to control the number of rotation of the supply roller driving motor M thereby controlling the toner supply amount. However, when the mono-stable multi-vibrator is used as the main supply amount control section 69, it is possible to control the toner supply amount with more exactness and stability than a case where the number of rotation of the supply roller driving motor M is controlled for example.

The supply roller main driving section 70 drives (intermittently drives) the supply roller driving motor M acting as a rotation driving source of the supply roller 8, while receiving a driving signal from the main supply amount control section 69. As a result, the supply roller 8 is rotated, and toner in the toner supply tank 7 is supplied to the developing chamber 4.

The toner density detection section 73 detects toner density in the developing chamber 4 based on an output signal from the toner density sensor 100, and outputs the result of the detection to the subsidiary supply amount calculation section 74.

The subsidiary supply amount calculation section 74 receives input from: the toner density detection value from the toner density detection section 73; the toner density targeted value stored in the toner density targeted value storage section 81*b* in the RAM 81; and the toner consumption ratio (corrected consumption ratio) that has been corrected by the correction consumption ratio calculation section 65 via the subsidiary supply timing control section 72. The subsidiary supply amount calculation section 74 subtracts, from the toner amount (toner targeted value) to be contained in the developing chamber 4 so as to adjust the toner density in the developing chamber 4 to be the toner density targeted value, (i) the toner amount contained in the developing chamber 4 calculated from the toner density detection value and (ii) the corrected consumption ratio inputted via the subsidiary supply timing control section 72, and integrates the result of the subtraction. On this account, the result of the toner density detection allows calculation of the toner amount required in adjusting the toner density in the developing chamber 4 to be the toner density targeted value after supplying toner whose toner supply amount (main supply amount) is based on the toner consumption ratio calculated from image data.

Note that the corrected consumption ratio inputted to the subsidiary supply amount calculation section 74 from the subsidiary supplying timing control section 72 is calculated by the corrected consumption ratio calculation section 65, and then delayed by the subsidiary supply timing control section (delay circuit) 72 by a delay time t2, and inputted to the subsidiary supply amount calculation section 74. Here, the delay time t2 is set as a time after the corrected consumption ratio calculation section 65 calculates a corrected consumption ratio based on image data so as to correspond to a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and is conveyed by the stirring roller 2 to the density detection region of the toner density sensor 100.

Based on the signal inputted from the subsidiary supply amount calculation section 74, the subsidiary supply amount control section 75 supplies a driving signal for driving the supply roller driving motor M or a stop signal for stopping the supply roller driving motor M to the supply roller subsidiary driving section 76. Namely, the supply roller driving motor M is driven so as to supply, to the developing chamber 4, toner whose supply amount (subsidiary supply amount) is calculated by the subsidiary supply amount calculation section 74. Note that the subsidiary supply amount control section 75 is constituted of, for example, a mono-stable multi-vibrator that outputs a pulse having a certain time interval when a trigger pulse is inputted, and is intermittently driven with a timing according to the toner amount to be supplied. Note that the subsidiary supply control section 75 is not limited to the mono-stable multi-vibrator, and may be arranged so as to control the number of rotation of the supply roller driving motor M thereby controlling the toner supply amount. However, when the mono-stable multi-vibrator is used as the subsidiary supply amount control section 75, it is possible to control the toner supply amount with more exactness and stability than a case where the number of rotation of the supply roller driving motor M is controlled for example.

The supply roller subsidiary driving section 76 drives the supply roller driving motor M acting as the rotation driving source of the supply roller 8, while receiving a driving signal from the subsidiary supply amount control section 75. As a result, the supply roller 8 supplies the toner in the toner supply tank 7 to the developing chamber 4.

[Operation of Toner Density Control System 60]

Figure 1:
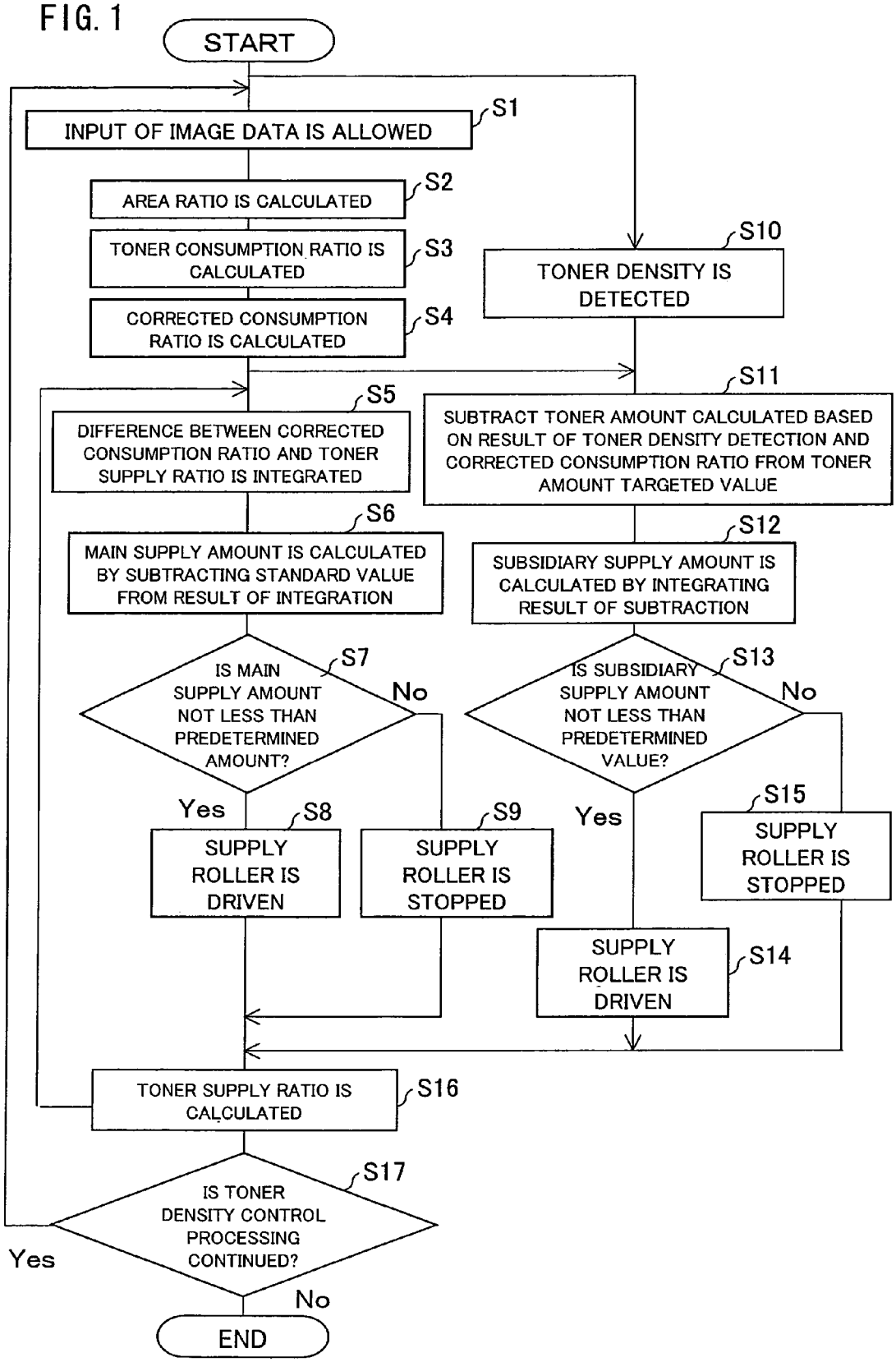
FIG. 1 is a flow chart illustrating a flow of toner density control operation carried out in an image forming apparatus according to one embodiment of the present invention.

The operation of the toner density control system 60 is explained. FIG. 1 is a flow chart illustrating a flow of a toner density control operation carried out by the toner density control system 60.

When the image data input section 62 receives an input of image data (step S1), the control section 61 causes the area ratio calculation section 63 to calculate the area ratio of an image to be formed (step S2). Namely, the area ratio calculation section 63 weights and counts (pixel-count) the input signal value of an inputted many-valued image for each pixel, based on a weight coefficient stored in the weight coefficient table 93, accumulates pixel counts, and calculates the ratio (area ratio) of the sum of accumulates values to the area of the image forming region.

The control section 61 causes the toner consumption ratio calculation section 64 to calculate a toner consumption ratio based on the area ratio thus calculated (step S3).

Further, the control section 61 causes the corrected consumption ratio calculation section 65 to calculate a corrected consumption ratio by reducing the toner consumption ratio at a predetermined ratio (multiplying the toner consumption ratio by a predetermined correction ratio that is less than 1) (step S4). At that time, correction is performed so that the corrected toner consumption ratio is smaller than a value calculated by subtracting the maximum value of a difference between the toner consumption ratio calculated by the toner consumption ratio calculation section 64 and an actual toner consumption ratio, from the toner consumption ratio calculated by the toner consumption ratio calculation section 64.

For example, in a case where the maximum value of the difference between the toner consumption ratio calculated by the toner consumption ratio calculation section 64 and the actual toner consumption ratio is +/−20%, the toner consumption ratio after correction (corrected consumption ratio) is set to a value not more than 80% of the calculated toner consumption ratio. In this case, in order to prevent excessive supply more surely, the corrected consumption ratio may be set to, for example, a value (e.g. 70%) less than the value that is not more than 80% of the calculated toner consumption ratio. Further, in a case where the maximum value of the difference between the toner consumption ratio calculated by the toner consumption ratio calculation section 64 and the actual toner consumption ratio is +/−5%, the corrected consumption ratio may be set to a value not more than 95% (e.g. 90%) of the calculated toner consumption ratio.

After that, the control section 61 causes the main supply lacking amount calculation section 67 to subtract the corrected consumption ratio calculated in step S4 and a toner supply ratio calculated in later-mentioned step S14, and to integrate the result of the subtraction (step S5).

To be more specific, the control section 61 causes the main supply timing control section 66 to delay the corrected consumption ratio calculated by the corrected consumption ratio calculation section 65 by a predetermined time (delay time t1) and to output the corrected consumption ratio to the main supply lacking amount calculation section 67. Here, the delay time t1 is set as a time after the corrected consumption ratio calculation section 65 calculates the corrected consumption ratio so as to correspond to a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and is conveyed by the stirring rollers 2 and 3 to the vicinity of the supply roller 8.

Further, the control section 61 causes the toner supply ratio calculation section 71 to calculate a supply amount per unit time (toner supply ratio) of toner that has been supplied during the delay time t1, and to output the amount to the main supply lacking amount calculation section 67.

Then, the control section 61 causes the main supply lacking amount calculation section 67 to subtract, from the corrected consumption ratio that has been delayed by the delay time t1 and inputted, a toner supply ratio of toner that has been supplied during the period corresponding to the delay time t1, and to integrate the result of the subtraction.

After that, the control section 61 causes the main supply standard comparison section 68 to subtract a standard value stored in the standard value storage section 81*a* in the RAM 81 from the result of integration in step S5, and to calculate a toner supply amount (main supply amount) based on the toner consumption ratio (corrected consumption ratio) calculated from image data (step S6).

Then, the control section 61 causes the main supply amount control section 69 to judge whether the main supply amount calculated in step S6 is not less than a predetermined amount or not (step S7).

Here, when the main supply amount calculated in step S6 is not less than the predetermined amount, the control section 61 causes the main supply amount control section 69 to output the driving signal for driving the supply roller driving motor M to the supply roller main driving section 70 (step S8). Further, when the main supply amount calculated in step S6 is less than the predetermined value, the control section 61 causes the main supply amount control section 69 to output the stop signal for stopping the supply roller driving motor M to the supply roller main driving section 70 (step S9).

Further, during a time when control processing of toner density is performed, the control section 61 causes the toner density detection section 73 to detect toner density in the developing chamber 4 (step S10). Namely, along with the processings in the steps S1 through S9, an output signal from the toner density sensor 100 is inputted to the toner density detection section 73, and the control section 61 causes the toner density detection section 73 to perform detection processing of toner density, based on the output signal from the toner density sensor 100. Further, the control section 61 causes the toner density detection section 73 to output the result of detection of the toner density to the subsidiary supply amount calculation section 74.

Then, the control section 61 causes the subsidiary supply amount calculation section 74 to subtract, from a toner amount (toner targeted amount) to be contained in the developing chamber 4 so as to adjust toner density in the developing chamber 4 to be a toner density targeted amount, (i) a toner amount contained in the developing chamber 4 calculated from the toner density detection value and (ii) a corrected consumption ratio inputted via the subsidiary supply timing control section 72 (step S11).

Note that the control section 61 causes the corrected consumption ratio calculated by the corrected consumption ratio calculation section 65 to be outputted to the subsidiary supply amount calculation section 74 after causing the subsidiary supply timing control section 72 to delay the timing by a predetermined time (delay time t2). Here, the delay time t2 is set as a time after the corrected consumption ratio calculation section 65 calculates a corrected consumption ratio so as to correspond to a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and is conveyed by the stirring roller 2 to the density detection region of the toner density sensor 100.

Further, the control section 61 causes the subsidiary supply amount calculation section 74 to integrate the result of subtraction in step S11 and to calculate a subsidiary supply amount (step S12).

After that, the control section 61 causes the subsidiary supply amount control section 75 to judge whether the subsidiary supply amount calculated in step S12 is not less than a predetermined value or not (step S13).

When the subsidiary supply amount calculated in step S12 is not less than the predetermined amount, the control section 61 causes the subsidiary supply amount control section 75 to output the driving signal for driving the supply roller driving motor M to the supply roller subsidiary driving section 76 (step S14). When the subsidiary supply amount calculated in step S12 is less than the predetermined amount, the control section 61 causes the subsidiary supply amount control section 75 to output the stop signal for stopping the supply roller driving motor M to the supply roller subsidiary driving section 76 (step S15).

Further, the control section 61 causes the toner supply ratio calculation section 71 to calculate the toner supply ratio during the delay time t1, and to output the toner supply ratio to the main supply lacking amount calculation section 67 (step S16).

To be more specific, the control section 61 causes the toner supply ratio calculation section 71 to calculate a supply amount per unit time (toner supply ratio) of toner that has been supplied to the developing chamber 4 during the delay time t1, and to output (feed back) the toner supply ratio to the main supply lacking amount calculation section 67.

After that, the control section 61 judges whether or not to continue the toner density control processing (step S17). When the toner density control processing is continued, the control section 61 performs again processings from step S1. When the toner density control processing is finished, the control section 61 stops operation of the toner density control system 60, and finishes the processing.

As described above, in the present embodiment, toner supply (main supply) is performed based on a toner consumption ratio calculated from image data. Therefore, when toner is consumed in the development processing, it is possible to supply toner with less time delay.

Further, in the present embodiment, a toner consumption ratio calculated from image data by the toner consumption ratio calculation section 64 is corrected so as to be smaller than a value calculated by subtracting the maximum value of a difference between the toner consumption ratio and an actual toner consumption ratio from the toner consumption ratio. As a result, it is possible to surely prevent excessive supply of toner which is caused by the difference between the calculated toner consumption ratio and the actual toner consumption ratio.

Further, in the present embodiment, toner supply (main supply) is performed based on the corrected consumption ratio calculated by subtracting the toner consumption ratio calculated from image data (by multiplying the toner consumption ratio by a predetermined correction ratio), and toner lacking amount after performing the main supply is calculated based on the result of detection of toner density sensor so as to supply toner (subsidiary supply). Namely, a toner amount in the developing chamber 4 calculated based on the result of detection of the toner density sensor and a corrected consumption ratio calculated by the corrected consumption ratio calculation section 65 are subtracted from the toner amount (toner targeted amount) to be contained in the developing chamber 4 so as to adjust the toner density in the developing chamber 4 to be the toner density targeted value, and it is calculated how much toner density falls short of the toner targeted amount after performing toner supply (main supply) based on the corrected consumption ratio. Then, toner supply (subsidiary supply) is performed based on the calculated toner lacking amount.

As a result, toner supply (main supply) is performed based on a toner consumption ratio calculated from image data, thereby supplying toner without delay. Further, toner supply (main supply) is performed based on the corrected consumption ratio calculated by multiplying the toner consumption ratio by a predetermined correction ratio, thereby preventing excessive supply of toner. Further, toner corresponding to a shortfall (toner lacking amount) of the toner supply amount based on the corrected consumption ratio is supplied (subsidiary supply) based on the result of detection of the toner density sensor, so that the toner density in the developing chamber 4 can be made closer to the toner density targeted value and the toner density can be stabilized.

Further, in the present embodiment, toner supply (main supply) based on the toner consumption ratio (corrected consumption ratio) calculated from image data is performed after the corrected consumption ratio calculation section 65 has calculated a corrected consumption ratio and then the delay time t1 has passed. The delay time t1 is a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and conveyed by the stirring rollers 2 and 3 to the vicinity of the supply roller 8.

As a result, after developing an image corresponding to image data, it is possible to perform, with a suitable timing, toner supply corresponding to toner consumption caused by the development processing of the image. Further, because a necessary amount of toner can be supplied to a region where toner density drops due to the development processing, it is possible to further uniformize the toner density in the developing chamber 4.

Further, in the present embodiment, as to the toner supply (subsidiary supply) based on the detection result of the toner density sensor, the corrected consumption is calculated by the corrected consumption ratio calculation section 65, and the calculated corrected consumption ratio and the detected toner density are subtracted from the toner density targeted value after the delay time t2 has passed, thereby calculating the toner supply amount (subsidiary supply amount). The delay time t2 is a time during which: an image corresponding to the image data used for calculation of the corrected consumption ratio is developed between the developing roller 1 and the photoconductor drum 48, and toner remaining on the developing roller 1 after performing the development processing is collected into the developing chamber 4 and conveyed to the toner density detection region of the toner density sensor 100.

Namely, the toner supply amount (subsidiary supply amount) is calculated, based on: the corrected consumption ratio calculated by the corrected consumption ratio calculation section 65; and the toner density at a time when remaining toner of toner used for the development processing of an image corresponding to image data used for calculation of the corrected consumption ratio is conveyed to the toner density detection region via a predetermined route.

As a result, it is possible to prevent the amount of toner supply (main supply) based on the corrected consumption ratio from being added to the amount of toner supply (subsidiary supply) based on the result of detection of the toner density sensor 100. Therefore, even when supply (main supply) based on the corrected consumption ratio and supply (subsidiary supply) based on the result of detection of the toner density are used together, it is possible to surely prevent excessive supply of toner.

Further, in the present embodiment, the main supply lacking amount calculation section 67 subtracts the toner supply ratio from the corrected consumption ratio and integrates the result of subtraction, thereby calculating the toner supply amount (main supply amount). Namely, supply operation is performed based on integration (accumulation) of the toner consumption ratio (printing consumption ratio).

In general, it is difficult to perform a supply control with high controllability (high linearity). Namely, it is difficult to perform the supply control so that the difference between an actual toner consumption amount and a toner amount to be supplied is always constant (direct line). Particularly, when images having low printing ratios are sequentially received (when image data whose image forming amount per one page is little are sequentially received), discordance of a toner supply operation (control error of toner density) is large. On the other hand, in the present embodiment, a toner supply amount is controlled based on accumulation of the corrected consumption ratio (value calculated by subtracting a toner supply ratio from a corrected consumption ratio), thereby stabilizing toner supply. For example, toner is supplied based on accumulation of a corrected consumption ratio derived from development processing carried out with respect to one or more pages, thereby stabilizing toner supply even in a case of a low printing ratio.

Further, in the present embodiment, each of the supply roller main driving section 70 and the supply roller subsidiary driving section 76 is constituted of the mono-stable multivibrator, so that both the driving sections intermittently drive the supply roller driving motor M according to the toner supply amount.

In this way, the supply amount is controlled by intermittent driving, thereby stabilizing the supply amount and realizing toner supply with a high controllability.

Note that, the present embodiment explained the arrangement in which the developing roller 1 and the stirring rollers 2 and 3 are provided. However, the arrangement of the development device 10 is not limited to this. For example, the shapes and layouts of the developing roller 1 and the stirring roller 2 and 3, the number of the stirring rollers, the shape of the developing chamber 4, and the like may be different from those of the present embodiment. In a case where the arrangement of the developing device 10 is different from the above arrangement, the delay time t1 may be set as a time after the corrected consumption ratio calculation section 65 calculates a corrected consumption ratio based on image data so as to correspond to a time during which: toner remaining on the developing roller (developer carrier) 1 after performing the development processing of an image corresponding to the image data used for calculation of the corrected consumption ratio is conveyed to the toner supply position via a predetermined route. Further, the delay time t2 may be set as a time after the corrected consumption ratio calculation section 65 calculates a corrected consumption ratio based on image data so as to correspond to a time during which: toner remaining on the developing roller (developer carrier) 1 after performing the development processing of an image corresponding to the image data used for calculation of the corrected consumption ratio is conveyed to the toner density detection region via a predetermined route.

Further, in the present embodiment, all processings carried out in the toner density control system 60 are controlled by the control section 61. However, the present invention is not limited to this, and may be arranged so that a program for performing the processings is stored in a storage medium and an information processing device capable of reading the program is used instead of the control section 61.

In the arrangement, a calculation device (such as CPU or MPU) of the information processing device reads out the program stored in the storage medium and carries out the processings. Therefore, the program itself realizes the processings.

As the information processing device, not only a general computer (work station or personal computer) but also a function extension board or a function extension unit that is attached to a computer can be used.

Further, the program is a program code (such as an executable program, an intermediate code program, and a source program) of software for realizing the processings. The program may be used solely, or may be used in combination with other program (such as OS). Further, the program may be temporarily stored in a memory (such as RAM) in the device after it has been read out from the storage medium, and be read again and executed.

Further, the storage medium for storing the program may be easily detachable from the information processing device, or may be fixed (set) to the device. Further, the storage medium may be connected to the device as an external storage device.

The storage medium is, for example, a magnetic tape, such as a video tape or a cassette tape; a magnetic disk, such as a floppy (registered trademark) disk or a hard disk; an optical disc (magnet-optical disc), such as a CD-ROM/MO/MD/DVD/CD-R; a memory card, such as an IC card or an optical card; and a semiconductor memory, such as a mask ROM, an EPROM, an EEPROM, or a flash ROM.

Further, the storage medium may be a storage medium connected to the information processing device via a network (such as an intranet or internet). At that time, the information processing device may be arranged so as to acquire the program by downloading via the network, namely, so as to acquire the program via a transmission medium (medium that carries a program in a flowing manner) such as the network (connected to a wired line or a wireless line). At that time, the program may be a computer data signal (data signal line). For example, by receiving the computer data signal transmitted in a carrier wave and causing a computer to execute operation based on the signal, the toner density control method of the present invention can be realized. Note that it is preferable that a program for downloading is stored in the device (alternatively, in a transmission-side device/reception-side device) beforehand.

As described above, the image forming apparatus according to the present invention is an image forming apparatus for developing, on a recording medium, an image corresponding to image data, by use of two-component developer constituted of toner and carrier, the image forming apparatus comprising: a developing chamber for containing the two-component developer used for development of the image; a supply member for supplying toner to the developing chamber; a toner consumption amount calculation section for calculating, based on the image data, an amount of toner consumption accompanying the development of the image corresponding to the image data; a corrected consumption amount calculation section for calculating a corrected consumption amount by multiplying the calculated amount of toner consumption by a predetermined correction ratio that is less than 1; and a toner density control section for causing the supply member to perform main supply in which toner is supplied to the developing chamber based on the calculated corrected consumption amount and for controlling toner density of the two-component developer contained in the developing chamber.

With the arrangement, the amount of toner consumption accompanying the development of the image corresponding to the image data is calculated based on the image data, and toner is supplied to the developing chamber based on the corrected consumption amount calculated by multiplying the calculated amount of toner consumption by the predetermined correction ratio that is less than 1. In this way, by controlling toner supply based on the amount of toner consumption calculated from the image data, it is possible to supply toner with little time delay from actual toner consumption. Further, by controlling the amount of toner supply based on the corrected consumption amount calculated by multiplying the calculated amount of toner consumption by the predetermined correction ratio that is less than 1, it is possible to prevent excessive supply of toner and suitably control the amount of toner supply even when there is a difference between the amount of toner consumption calculated from image data and the amount of actual toner consumption.

Further, in addition to the arrangement, the present invention may be arranged so that the image forming apparatus according to the present invention further comprises a toner density detection section for detecting toner density in the developing chamber, by use of a toner density sensor, the toner density control section subtracts, from an amount of toner to be contained in the developing chamber so as to adjust the toner density in the developing chamber to be a targeted value, (i) an amount of toner contained in the developing chamber calculated based on the toner density detected by the toner density detection section, and (ii) an amount of toner to be supplied to the developing chamber based on the corrected consumption amount, and the toner density control section causes the supply member to perform subsidiary supply in which toner whose amount corresponds to a result of the subtraction is supplied to the developing chamber.

With the arrangement, a lacking amount (toner lacking amount) of toner supply (main supply) based on the corrected consumption ratio is calculated by subtracting, from the amount of toner to be contained in the developing chamber so as to adjust the toner density in the developing chamber to be a targeted value, (i) the amount of toner contained in the developing chamber calculated based on the toner density detected by the toner density detection section and (ii) the amount of toner to be supplied to the developing chamber based on the corrected consumption amount. Then, in addition to the main supply, by supplying (subsidiary supply) toner corresponding to the toner lacking amount thus calculated based on the result of detection of the toner density detection section, it is possible to adjust the toner density in the developing chamber around the targeted value of the toner density and to stabilize the toner density.

It may be so arranged that the toner density control section calculates an amount of toner to be supplied in the subsidiary supply, based on (i) the corrected consumption amount and (ii) toner density detected when toner unused for the development and remaining on a position of the development is conveyed to a density detection region of the toner density sensor via a predetermined route in developing the image corresponding to the image data used for calculation of the corrected consumption amount.

With the arrangement, it is possible to prevent the toner to be supplied in the main supply from being additionally supplied in the subsidiary supply. Therefore, even when supply (main supply) based on the corrected consumption amount and supply (subsidiary supply) based on the result of detection of the toner density are combined, it is possible to surely prevent excessive supply of toner.

Further, it may be so arranged that the toner density control section performs main supply of toner based on the corrected consumption amount when toner unused for the development and remaining on a position of the development is conveyed via a predetermined route to a vicinity of a place where the supply member supplies toner in developing the image corresponding to the image data used for the calculation of the corrected consumption amount.

With the arrangement, after the image corresponding to the image data is developed, it is possible to supply toner in accordance with an amount of toner consumption caused by the development, with a suitable timing.

Further, it may be so arranged that the toner consumption amount calculation section calculates a toner consumption ratio that is a toner consumption amount per unit time, and the corrected consumption amount calculation section calculates a corrected consumption ratio by multiplying the toner consumption ratio by a predetermined correction ratio that is less than 1, and the corrected consumption amount calculation section calculates a corrected consumption amount per a predetermined time by integrating the corrected consumption ratio.

With the arrangement, the amount of toner supply is controlled based on accumulation (integration) of the corrected consumption ratio. As a result, for example, when image forming of image data with a low printing ratio (image data which requires a small amount of toner used for development processing on the development region) is performed, toner supply based on accumulation of the corrected consumption ratio allows for stabilized supply.

Further, it may be so arranged that the toner density control section intermittently operates the supply member according to an amount of toner to be supplied.

With the arrangement, because the amount of toner supply is controlled by intermittent driving, it is possible to stabilize the amount of toner supply and to perform toner supply with high controllability.

In order to solve the problem, the toner density control method according to the present invention is a method for controlling toner density of two-component developer, constituted of toner and carrier, which is contained in a developing chamber included in an image forming apparatus for developing, on a recording medium, an image corresponding to image data, by use of the two-component developer, said toner density control method comprising: a toner consumption amount calculation step for calculating, based on the image data, an amount of toner consumption accompanying development of the image corresponding to the image data; a corrected consumption amount calculation step for calculating a corrected consumption amount by multiplying the calculated amount of toner consumption by a predetermined correction ratio that is less than 1; and a main supply step for supplying toner to the developing chamber based on the calculated corrected consumption amount.

With the method, the amount of toner consumption accompanying the development of the image corresponding to the image data is calculated based on the image data, and toner is supplied to the developing chamber based on the corrected consumption amount calculated by multiplying the calculated amount of toner consumption by the predetermined correction ratio that is less than 1. In this way, by controlling toner supply based on the amount of toner consumption calculated from image data, it is possible to supply toner with little time delay from actual toner consumption. Further, by controlling an amount of toner supply based on the corrected consumption amount calculated by multiplying the calculated amount of toner consumption by a predetermined correction ratio that is less than 1, it is possible to prevent excessive supply of toner and suitably control an amount of toner supply even when there is a difference between the amount of toner consumption calculated from image data and the amount of actual toner consumption.

Further, in addition to the method, the toner density control method according to the present invention may include: a toner density detection step for detecting toner density in the developing chamber by use of a toner density sensor; and a subsidiary supply step for subtracting, from an amount of toner to be contained in the developing chamber so as to adjust the toner density in the developing chamber to be a targeted value, (i) an amount of toner contained in the developing chamber calculated based on the toner density detected by the toner density detection step, and (ii) an amount of toner to be supplied based on the corrected consumption amount, so as to supply toner whose amount corresponds to a result of the subtraction to the developing chamber.

With the method, by subtracting, from the amount of toner to be contained in the developing chamber so as to adjust the toner density in the developing chamber to be a targeted value, (i) the amount of toner contained in the developing chamber calculated based on the toner density detected by the toner density detection step and (ii) the amount of toner to be supplied to the developing chamber based on the corrected consumption amount, a lacking amount (toner lacking amount) of toner supply (main supply) based on a corrected consumption amount is calculated. Then, in addition to the main supply, by supplying (subsidiary supply) toner corresponding to the toner lacking amount thus calculated based on the result of detection of the toner density detection step, it is possible to adjust the toner density in the developing chamber around the targeted value of the toner density, and to stabilize the toner density.

Further, the toner density control method according to the present invention may be arranged so that in the subsidiary supply step, an amount of toner to be supplied in the subsidiary supply is calculated based on (i) the corrected consumption amount and (ii) toner density detected when toner unused for the development and remaining on a position of the development is conveyed to a density detection region of the toner density detection sensor via a predetermined route in developing the image corresponding to the image data used for the calculation of the corrected consumption amount.

With the method, it is possible to prevent toner to be supplied in the main supply from being additionally supplied in the subsidiary supply. Therefore, even when supply (main supply) based on the corrected consumption amount and supply (subsidiary supply) based on the result of detection of the toner density are combined, it is possible to surely prevent excessive supply of toner.

Further, the toner density control method according to the present invention may be arranged so that in the main supply step, main supply of toner is performed based on the corrected consumption amount when toner unused for the development and remaining on a position of the development is conveyed via a predetermined route to a vicinity of a place where toner is supplied in developing the image corresponding to the image data used for the calculation of the corrected consumption amount.

With the method, after the image corresponding to the image data is developed, it is possible to supply toner in accordance with an amount of toner consumption caused by the development, with a suitable timing.

Further, the toner density control method according to the present invention may be arranged so that a toner consumption ratio that is a toner consumption amount per unit time is calculated in the toner consumption amount calculation step, and a corrected consumption ratio is calculated by multiplying the toner consumption ratio by a predetermined correction ratio that is less than 1 and a corrected consumption amount per a predetermined time is calculated by integrating the corrected consumption ratio in the corrected consumption amount calculation step.

With the method, the amount of toner supply is controlled based on accumulation (integration) of the corrected consumption ratio. As a result, for example, when image forming of image data with a low printing ratio (image data which requires a small amount of toner used for development processing on the development region) is performed, toner supply based on accumulation of the corrected consumption ratio allows for stabilized supply.

Further, the toner density control method according to the present invention may be arranged so that in the main supply step and/or the subsidiary supply step, a supply member that is included in the image forming apparatus and supplies toner to the developing chamber is intermittently operated according to an amount of toner to be supplied.

With the method, because the amount of toner supply is controlled by intermittent driving, it is possible to stabilize the amount of toner supply and perform toner supply with a high controllability.

The toner density control program according to the present invention causes a computer to carry out any one of the toner density control methods. By causing a computer to read the program, it is possible for the computer to realize processing of each step in the toner density control method according to the present invention.

Further, by storing the program in a computer-readable storage medium, it is possible to easily maintain and distribute the program. Further, by causing a computer to read the storage medium, it is possible for the computer to carry out the processing of each step in the toner density control method according to the present invention.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus for developing, on a recording medium, an image corresponding to image data, by use of two-component developer constituted of toner and carrier, said image forming apparatus comprising:

a developing chamber for containing the two-component developer used for development of the image;

a supply member for supplying toner to the developing chamber;

a toner consumption amount calculation section for calculating, based on the image data, an amount of toner consumption accompanying the development of the image corresponding to the image data;

a corrected consumption amount calculation section for calculating a corrected consumption amount by multiplying the calculated amount of toner consumption by a predetermined correction ratio that is less than 1, so that the corrected consumption amount is always smaller than the actual toner consumption; and a toner density control section for causing the supply member to perform main supply in which toner is supplied to the developing chamber based on the calculated corrected consumption amount and for controlling toner density of the two-component developer contained in the developing chamber.

2. The image forming apparatus as set forth in claim 1, wherein the toner density control section performs main supply of toner based on the corrected consumption amount when toner unused for the development and remaining on a position of the development is conveyed via a predetermined route to a vicinity of a place where the supply member supplies toner in developing the image corresponding to the image data used for the calculation of the corrected consumption amount.

3. The image forming apparatus as set forth in claim 1, wherein:

the toner consumption amount calculation section calculates a toner consumption ratio that is a toner consumption amount per unit time, and the corrected consumption amount calculation section calculates a corrected consumption ratio by multiplying the toner consumption ratio by a predetermined correction ratio that is less than 1, and the corrected consumption amount calculation section calculates a corrected consumption amount per a predetermined time by integrating the corrected consumption ratio.

4. The image forming apparatus as set forth in claim 1, wherein the toner density control section intermittently operates the supply member according to an amount of toner to be supplied.

5. An image forming apparatus for developing, on a recording medium, an image corresponding to image data, by use of two-component developer constituted of toner and carrier, said image forming apparatus comprising:

a developing chamber for containing the two-component developer used for development of the image;

a supply member for supplying toner to the developing chamber;

a toner consumption amount calculation section for calculating, based on the image data, an amount of toner consumption accompanying the development of the image corresponding to the image data;

a corrected consumption amount calculation section for calculating a corrected consumption amount by multiplying the calculated amount of toner consumption by a predetermined correction ratio that is less than 1;

a toner density control section for causing the supply member to perform main supply in which toner is supplied to the developing chamber based on the calculated corrected consumption amount and for controlling toner density of the two-component developer contained in the developing chamber; and a toner density detection section for detecting the toner density in the developing chamber by use of a toner density sensor, wherein the toner density control section subtracts, from an amount of toner to be contained in the developing chamber so as to adjust the toner density in the developing chamber to be a targeted value, (i) an amount of toner contained in the developing chamber calculated based on the toner density detected by the toner density detection section and (ii) an amount of toner to be supplied to the developing chamber based on the corrected consumption amount, and the toner density control section causes the supply member to perform subsidiary supply in which toner whose amount corresponds to a result of the subtraction is supplied to the developing chamber.

6. The image forming apparatus as set forth in claim 5, wherein the toner density control section calculates an amount of toner to be supplied in the subsidiary supply based on (i) the corrected consumption amount and (ii) toner density detected when toner unused for the development and remaining on a position of the development is conveyed to a density detection region of the toner density sensor via a predetermined route in developing the image corresponding to the image data used for the calculation of the corrected consumption amount.

7. A toner density control method for controlling toner density of two-component developer, constituted of toner and carrier, which is contained in a developing chamber included in an image forming apparatus for developing, on a recording medium, an image corresponding to image data, by use of the two-component developer, said toner density control method comprising:

a toner consumption amount calculation step for calculating, based on the image data, an amount of toner consumption accompanying development of the image corresponding to the image data;

a corrected consumption amount calculation step for calculating a corrected consumption amount by multiplying the calculated amount of toner consumption by a predetermined correction ratio that is less than 1, so that the corrected consumption amount is always smaller than the actual toner consumption; and a main supply step for supplying toner to the developing chamber based on the calculated corrected consumption amount.

8. The method as set forth in claim 7, wherein in the main supply step, main supply of toner is performed based on the corrected consumption amount when toner unused for the development and remaining on a position of the development is conveyed to a vicinity of a place where toner is supplied in developing the image corresponding to the image data used for the calculation of the corrected consumption amount.

9. The method as set forth in claim 7, wherein:

a toner consumption ratio that is a toner consumption amount per unit time is calculated in the toner consumption amount calculation step, and a corrected consumption ratio is calculated by multiplying the toner consumption ratio by a predetermined correction ratio that is less than 1 and a corrected consumption amount per a predetermined time is calculated by integrating the corrected consumption ratio in the corrected consumption amount calculation step.

10. The method as set forth in claim 7, wherein in the main supply step and/or the subsidiary supply step, a supply member that is included in the image forming apparatus and supplies toner to the developing chamber is intermittently operated according to an amount of toner to be supplied.

11. A toner density control method for controlling toner density of two-component developer, constituted of toner and carrier, which is contained in a developing chamber included in an image forming apparatus for developing, on a recording medium, an image corresponding to image data, by use of the two-component developer, said toner density control method comprising:

a toner consumption amount calculation step for calculating, based on the image data, an amount of toner consumption accompanying development of the image corresponding to the image data;

a corrected consumption amount calculation step for calculating a corrected consumption amount by multiplying the calculated amount of toner consumption by a predetermined correction ratio that is less than 1;

a main supply step for supplying toner to the developing chamber based on the calculated corrected consumption amount;

a toner density detection step for detecting toner density in the developing chamber by use of a toner density sensor; and a subsidiary supply step for subtracting, from an amount of toner to be contained in the developing chamber so as to adjust the toner density in the developing chamber to be a targeted value, (i) an amount of toner contained in the developing chamber calculated based on the toner density detected by the toner density detection step and (ii) an amount of toner to be supplied based on the corrected consumption amount, so as to supply toner whose amount corresponds to a result of the subtraction to the developing chamber.

12. The method as set forth in claim 11, wherein in the subsidiary supply step, an amount of toner to be supplied in the subsidiary supply is calculated based on (i) the corrected consumption amount and (ii) toner density detected when toner unused for the development and remaining on a position of the development is conveyed to a density detection region of the toner density sensor via a predetermined route in developing the image corresponding to the image data used for the calculation of the corrected consumption amount.

13. A computer-readable storage medium, storing a toner density control program for causing a computer to carry out a toner density control method for controlling toner density of two-component developer, constituted of toner and carrier, which is contained in a developing chamber included in an image forming apparatus for developing, on a recording medium, an image corresponding to image data, by use of the two-component developer, wherein the toner density control method comprises:

a toner consumption amount calculation step for calculating, based on the image data, an amount of toner consumption accompanying development of the image corresponding to the image data;

a corrected consumption amount calculation step for calculating a corrected consumption amount by multiplying the calculated amount of toner consumption by a predetermined correction ratio that is less than 1, so that the corrected consumption amount is always smaller than the actual toner consumptions; and a main supply step for supplying toner to the developing chamber based on the calculated corrected consumption amount.

* * * * *